United States Patent [19]

Costa

[11] 3,977,554

[45] Aug. 31, 1976

[54] CHILD-PROOF CLOSURE DEVICE FOR A CONTAINER HAVING A THREADED NECK PORTION

[76] Inventor: Allan Costa, Melville Park Road, Melville, N.Y. 11746

[22] Filed: Jan. 23, 1975

[21] Appl. No.: 543,346

[52] U.S. Cl. ..... 215/220

[51] Int. Cl.[2] ..... B65D 55/02; B65D 85/56; A61J 1/00

[58] Field of Search ..... 215/9, 220

[56] References Cited

UNITED STATES PATENTS

| | | | |
|---|---|---|---|
| 3,669,294 | 6/1972 | Petronelli et al. | 215/220 |
| 3,809,274 | 5/1974 | Scuderi | 215/9 |
| 3,870,182 | 3/1975 | Georgi | 215/220 |

*Primary Examiner*—George T. Hall
*Attorney, Agent, or Firm*—Hane, Baxley & Spiecens

[57] ABSTRACT

There is disclosed a child-proof closure device for a container such as a bottle having a threaded neck portion. This closure device comprises a closure cap which has on the outside of its side wall a row of teeth and a drive cap which has on the inside of its drive wall a row of teeth and is fitted upon the closure cap. The two caps are dimensioned relative to each other so that the drive cap in a lowered or inactive position relative to the closure cap can be rotated and is axially displaceable relative to the screw cap so that it can be lifted into a raised or active position. In the latter position, the two rows of teeth are in rotation transmitting engagement whereby turning of the drive cap causes turning of the closure cap so as to screw the same off or on. The drive cap will drop into its inactive position by the force of gravity unless held in the active position. Hence, a person who wants to screw off or on the screw cap must perform several coordinated movements, namely, lift the drive cap, hold the same in the lifted position and turn the drive cap. Such coordinated and simultaneous operations constitute an efficient safety factor against opening of the container by a young child. Yet, the performance of these coordinated oeprations requires virtually no physical strength or special mechanical skill.

7 Claims, 5 Drawing Figures

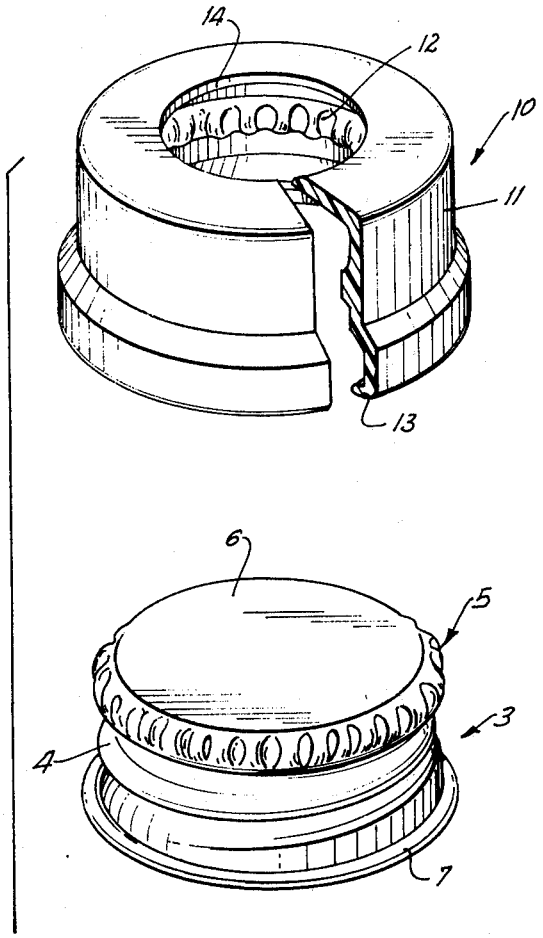
FIG. 1
FIG. 4
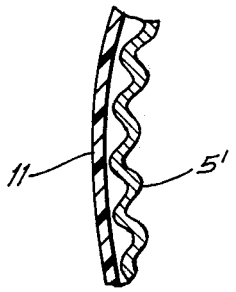
FIG. 5
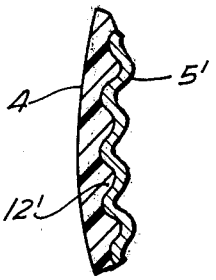
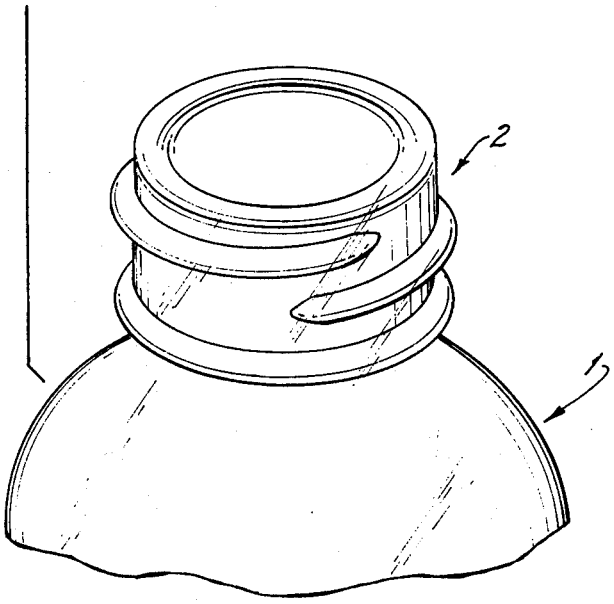

CHILD-PROOF CLOSURE DEVICE FOR A CONTAINER HAVING A THREADED NECK PORTION

The invention relates to a child-proof closure device for closing or opening a container and, more particularly, to a child-proof closure device for opening or closing a container such as a bottle having a threaded neck portion.

BACKGROUND

It has been found that serious health damage and even death of young children are far from rare by playing of children with containers such as bottles, cans, etc. containing pharmaceutical preparations and then eating sucn preparations, the more so as they often appear to be similar to candy and also by playing with containers filled with liquids or powders as used in households such as detergents, powerful solvents, bleaches, etc. Injuries caused by opening of containers with a potentially harmful content have reached such alarming proportions that a Poison Prevention Packaging Act was enacted in 1970. This Act states that there is a need for providing special packaging to protect children from serious personal injury or illness resulting from handling, using or ingesting household substances which may be toxic, such as medicines, detergents, drain cleaners, etc. As a result of this Act, various types of so-called child-proof closures have been developed and are now in general use. There are three types available — one type requires exerting and maintaining strong manual pressure in axial direction between a drive member and the closure cap proper to permit opening or closing of the latter; the second type requires the application of powerful radial pressure upon the drive member for squeezing teeth on the closure cap and the drive member into rotation transmitting engagement and a third type requires placement of the drive member into accurate rotational register with the closure cap. While the required axial or radial pressure which must be maintained until the closure cap is screwed off or on, may prevent opening of a container by a young child, it also makes the use of this type of closure device difficult, if not impossible, to use by very many adult persons. Women often have not the necessary physical strength to manipulate closure devices of this type and people whose fingers have lost their dexterity due to arthritic or rheumatic stiffness also will find it difficult if not impossible to open a bottle closed by a child-proof closure device, and just such persons have the need of opening and closing containers filled with drugs which they must use. The type which requires placement of the drive member and the closure cap into exact register is difficult to handle if the light conditions are not very good and for persons who have poor eyesight; usually the markings on the drive member and the closure cap are very tiny and often pale so that they are difficult to see.

THE INVENTION

It is a broad object of the invention to provide a novel and improved child-proof closure device which combines safety against opening of a container by a young child with extremely simple manipulation and which does not require physical strength or dexterity.

A more specific object of the invention is to provide a novel and improved closure device the drive member of which is operated simply by axially displacing it from an inactive position into an active position permitting screwing on or off of the closure cap and automatically returns into its inactive position by its own weight if released.

Another more specific object of the invention is to provide a novel and improved child-proof closure device which does not require application of pressure either in axial direction or squeezing in radial direction to effect screwing off or on the closure cap.

A further more specific object of the invention is to provide a novel and improved child-proof closure device which prevents that after the initial opening of a container the closure cap cannot be screwed on so tightly that it would be difficult for a person whose finger strength or dexterity is limited to loosen the cap.

Still another more specific object of the invention is to provide a novel and improved child-proof closure device which permits the user either to hold the container with one hand and pull the drive member with the other hand into the position for screwing the closure cap off or on, or to hold the drive member with one hand and to turn the container itself with the other hand for screwing the closure cap on or off. This possibility facilitates the manipulation of the closure device for persons whose use of fingers is limited as obviously the container itself can be more easily gripped than the small drive member.

SUMMARY OF THE INVENTION

The afore-pointed out objects, features and advantages and other objects, features and advantages which will be pointed out hereinafter are obtained by providing a screw-type closure cap and a cap-shaped drive member which is fitted upon the closure cap. The diameters of the side walls of the closure cap and of the drive cap are so correlated that the drive cap is rotatable and axially displaceable relative to the screw cap. The closure cap has on the outside of its side wall a row of teeth and the drive cap has on the inside of its side wall also a row of teeth. Moreover, the side wall of the drive cap and the side wall of the closure cap have coacting stop means which limit axial displacement of the drive cap relative to the closure cap between a position in which the rows of teeth on the closure cap and on the drive cap are axially separated and a position in which the two rows of teeth are in rotation-transmitting engagement so that the closure cap can be screwed off or on by turning the drive cap in one direction or the other.

Displacement of the drive cap from its inactive position into the active position is effected either by holding the container with one hand and raising the drive cap with the other hand, or holding the drive cap with one hand and letting the container drop by its own weight.

BRIEF DESCRIPTION OF THE DRAWING FIGURES

In the accompanying drawing a preferred embodiment of the invention is shown by way of illustration and not by way of limitation.

In the drawing:

FIG. 1 is an exploded perspective view, partly in section, of a child-proof closure device and of a container with a threaded neck portion to be opened or closed by means of the device according to the invention;

FIG. 4 is a fragmentary section taken along line IV—IV of FIG. 2; and

FIG. 5 is a fragmentary sectional view taken on line V—V of FIG. 3.

DETAILED DESCRIPTION OF THE DRAWING FIGURES

Figure 2:
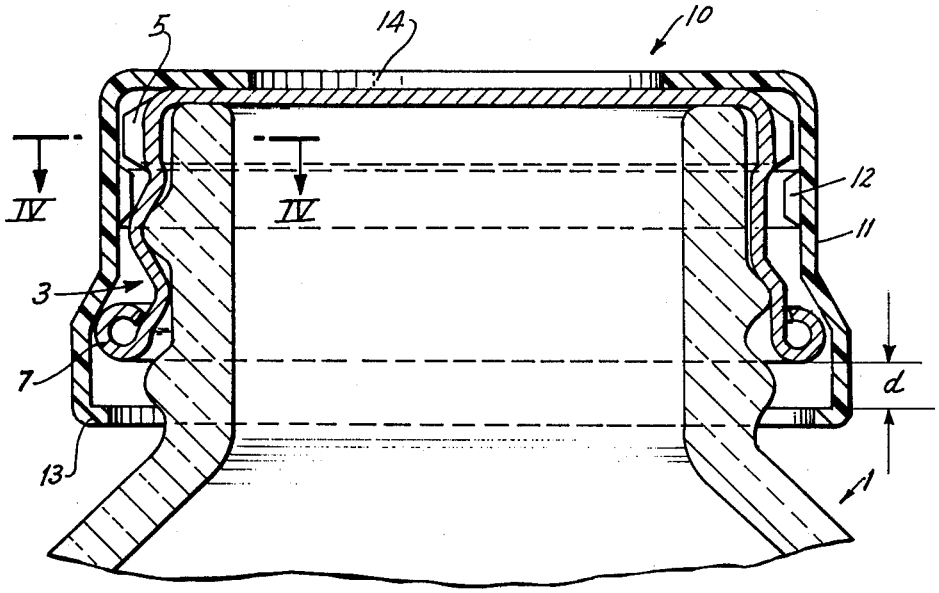
FIG. 2 is an elevational sectional view of the closure device placed upon the neck portion of the container and shown in a position preventing opening of the container.

Referring now to the drawing figures more in detail, and first to FIG. 1, this figure shows a container 1 having a threaded neck portion. The container is shown as a bottle made of glass, plastic, paper or metal, but may also be a can having a neck threaded portion. FIG. 1 further shows a screw-type closure cap 3 (or a bayonet-lock type closure cap) having in its side wall threads 4 engageable with the threads of neck portion 2. The closure cap is further formed with a continuous or interrupted circumferential row of teeth 5 adjacent to its base wall 6. There is also provided an outwardly turned lip or bead 7. The closure cap 3 constitutes one part of a child-proof closure device according to the invention. The second part is a drive member 10 which is generally cap-shaped. The inside of side wall 11 of the cap is formed with a continuous or interrupted circumferential row of teeth 12. The edge of side wall 11 terminates in an inwardly turned lip 13. The base wall of drive cap 10 includes an opening 14 for a purpose which will be explained hereinafter.

The drive cap and also the screw cap may be made of a suitable sheet metal but the drive cap is preferably made of synthetic plastics material, and, more particularly, of plastics material which has an inherent flexibility for a purpose which will be more fully explained hereinafter. There are many synthetic plastics materials known and available in the market which will be suitable for the purpose, such as polyethylene or polyvinyl chloride.

Figure 3:
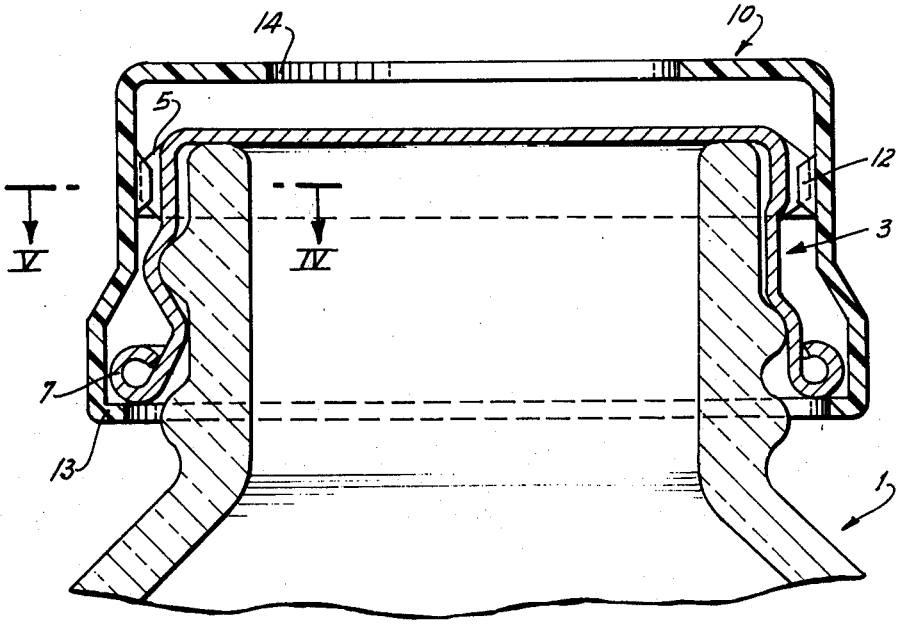
FIG. 3 is an elevational sectional view similar to FIG. 2 but showing the closure device in the position for opening or closing the container.

Turning now to FIGS. 2 and 3, it is shown in these figures that drive cap 10 has been fitted upon closure cap 3. The relative diametric dimensions of both caps are so that the drive cap can be freely rotated relative to the closure cap when in the position of FIG. 2. The side wall of the drive cap is longer than the side wall of the closure cap so that an axial displacement of the drive cap relative to the closure cap and vice versa is possible. This displacement is limited by the distance between lip 7 on the closure cap and lip 13 on the drive cap, as it is indicated at *d*. The locations of the teeth 5 on the outside of the closure cap and of the teeth 12 on the inside of the drive cap are so correlated in axial direction that if the drive cap is in the position of FIG. 2, the two rows of teeth are disengaged but are engaged when the drive cap is placed in the position relative to the closure cap which is shown in FIG. 3. FIG. 2 further shows that when the drive cap is in the position of FIG. 2, its base wall 14 preferably rests upon the base wall of the closure cap while in the position of FIG. 3., i.e., in the position in which the rows of teeth are engaged, the base walls of the two caps are separated from each other.

OPERATION OF A CHILD-PROOF CLOSURE DEVICE ACCORDING TO THE INVENTION

As stated before, the two rows of teeth are disengaged in the position of FIG. 2. Accordingly, the drive cap can be rotated relative to the screw cap without causing a screwing off or on of the closure cap 3. In other words, the position of FIG. 2 represents the inactive position of the closure device. The drive cap of the closure device will automatically move into this position when a bottle or other container is placed in a more or less upright position due to the force of gravity acting upon the drive cap.

To remove the closure cap, the drive cap is lifted from the position of FIG. 2 into the position of FIG. 3. As the two rows of teeth in the latter position of the drive cap are now in engagement, turning of the drive cap in opposite direction will screw off or on the closure cap. The screwing-on movement of the cap is facilitated if the user presses a finger upon the base wall 6 of the closure cap through opening 14 in the drive cap, but a very tight screwing on of the closure cap cannot be effected by this manner.

As it is now apparent, the safety factor provided by the closure device against opening the bottle or other container by a playing young child resides in the fact that to open the closure cap three different movements must be made, namely, lifting the drive cap from the position of FIG. 2 into the position of FIG. 3, holding the drive cap in that position and turning the drive cap. The last two movements must be made simultaneously and it is very unlikely that a young child will perform all these movements accidentally or intentionally.

An additional safety factor may be introduced by giving the teeth in the two rows of teeth configurations as are shown in FIGS. 4 and 5. According to these figures, the teeth have rounded apices and rounded values. The purpose of such rounded teeth is that there must be a full engagement of the two rows of teeth as it is shown in FIG. 3 to transmit sufficient turning force from the drive cap to the closure cap while with sharp teeth a fractional engagement of the teeth may already be sufficient to effect unscrewing of the closure cap. Such fractional engagement of teeth may be accidentally effected by a playing child but full engagement such as shown in FIG. 3 requires a conscious and purposeful act.

The child-proof closure device according to the invention has also the advantage that it requires virtually no application of strength. All that is necessary is to lift the drive cap from the position of FIG. 2 into the position of FIG. 3 and then unscrewing the screw cap in the conventional manner. Moreover, the user can either hold the bottle and lift the cap as described or can hold the drive cap and lift the bottle. The latter manipulation may be more convenient to a person having stiffened fingers as it is obviously easier to grip and hold a bottle than a small item such as the drive cap.

ASSEMBLY OF A CHILD-PROOF DEVICE ACCORDING TO THE INVENTION

It is generally required that a closure cap is screwed on very tightly before it is used the first time, i.e., before the container is sold to a customer. The device according to the invention permits such tight screwing on of the closure cap in an economic manner by effecting it by suitable automatic machine tools before the drive cap is attached. After tightening of the closure cap the drive cap is simply snapped upon the screw cap. The herein-before mentioned inherent flexibility of the drive cap permits such snapping-on by means of suitable machine tools.

After the closure cap has been opened for the first time it is generally desirable not to tighten the cap as much as it was when it was initially screwed on. It has been found that strong persons have a tendency to tighten any cap automatically and a person whose fingers are arthritic or rheumatic or otherwise stiffened or weakened have then difficulties to loosen the cap. The closure device of the invention has an inherent limitation with respect to such strong tightening of the closure cap. While it presents little difficulty to loosen a tightly screwed-on cap for the first time, a tight screwing on of the cap is impeded as the drive cap and the screw cap will tend to slip relative to each other if too much turning pressure is exerted. In fact, it is generally necessary to exert pressure through opening 14 upon the base 6 of the closure to obtain sufficiently tight screwing of the screw cap.

While the invention has been described in detail with respect to a certain now preferred example and embodiment of the invention, it will be understood by those skilled in the art, after understanding the invention, that various changes and modifications may be made without departing from the spirit and scope of the invention, and it is intended therefore, to cover all such changes and modifications in the appended claims.

What is claimed is:

1. A child-proof closure device for a container having a threaded neck portion, said device comprising in combination:

a screw-type closure cap and a cap-shaped drive member fitted upon said closure cap, the outer diameter of the screw cap side wall and the inner diameter of the drive cap side wall being so correlated that the drive cap is rotatable and axially displaceable relative to the screw cap;

said closure cap having on the outside of its side wall a circumferentially extended row of teeth axially extended and disposed adjacent to the base wall of said cap, and said drive cap having on the inside of its side wall a circumferentially disposed row of axially extended teeth, the diametrical spacing of said teeth being such that upon placement of the two rows of teeth in a side-by-side position the teeth in the two rows are in rotation transmitting engagement;

the side wall of the drive cap and the side wall of the screw cap having coacting stop means limiting said axial displacement of the drive cap relative to the closure cap between an inactive position in which the drive cap is lowered relative to the screw cap and an active limit position in which the drive cap is raised relative to the screw cap, the relative axial position of said rows of teeth on the side walls of the drive cap and the cover cap, respectively, being such that upon placement of the drive cap in the active limit position the teeth of the two rows are in side-by-side position and thus in rotation-transmitting engagement for simultaneous turning of both said caps and upon placement of the drive cap the two rows of the teeth are in an axially spaced position and thus out of rotation transmitting engagement.

2. The child-proof closure cap according to claim 1 wherein the side wall of the drive cap is longer than that of the closure cap, and wherein said stop means comprises an inwardly turned lip at the end of the drive cap side wall.

3. The child-proof closure device according to claim 2 wherein the axial length of the side wall of the drive cap relative to that of the closure cap is such that in the inactive limit position of the drive cap the base wall thereof is supported by the base wall of the closure cap and in the active limit position the lip on the drive cap side wall engages the edge of the closure cap side wall, said drive cap moving automatically by the force of gravity into its inactive position when a container to which device is attached is in an approximately upright position.

4. The child-proof closure cap according to claim 3 wherein the side wall of the closure cap terminates in an outwardly turned lip coacting with said lip on the drive cap in the active position of the latter.

5. The child-proof closure device according to claim 1 wherein said drive cap is made of a synthetic plastics material having a flexibility such as to provide for temporary deformation sufficient to force the stop means on the drive cap past the stop means on the closure cap thereby.

6. The child-proof closure device according to claim 1 wherein the teeth in said rows have rounded apices and valleys.

7. The child-proof closure device according to claim 1 wherein the base wall of the drive cap includes an opening providing access to the underlying base wall of the closure cap.

* * * * *